US005882236A

United States Patent [19]

Ozawa et al.

[11] Patent Number: 5,882,236

[45] Date of Patent: Mar. 16, 1999

[54] EXHAUST SYSTEM FOR SMALL WATERCRAFT

[75] Inventors: Shigeyuki Ozawa; Shigeharu Mineo, both of Iwata, Japan

[73] Assignee: Yamaha Hatsudoki Kabushiki Kaisha, Japan

[21] Appl. No.: 790,743

[22] Filed: Jan. 27, 1997

[51] Int. Cl.[6] ..... B63B 21/32

[52] U.S. Cl. ..... 440/89; 114/270

[58] Field of Search ..... 114/270; 440/88, 440/89; 123/41.31

[56] References Cited

U.S. PATENT DOCUMENTS

| | | | |
|---|---|---|---|
| 4,773,883 | 9/1988 | Nakase et al. | 440/89 |
| 4,811,560 | 3/1989 | Nakase et al. | 440/89 |
| 4,989,409 | 2/1991 | Nakase et al. | 440/89 |
| 4,997,399 | 3/1991 | Nakayasu et al. | 440/89 |
| 5,067,448 | 11/1991 | Nakase et al. | 123/41.31 |
| 5,096,446 | 3/1992 | Tazaki et al. | 440/89 |
| 5,234,364 | 8/1993 | Ito | 440/89 |
| 5,324,217 | 6/1994 | Mineo | 440/89 |
| 5,366,401 | 11/1994 | Nanami et al. | 440/89 |
| 5,449,305 | 9/1995 | Kobayashi et al. | 440/38 |
| 5,490,474 | 2/1996 | Ikeda | 440/89 |
| 5,511,505 | 4/1996 | Kobayashi et al. | 440/89 |
| 5,531,620 | 7/1996 | Ozawa et al. | 440/89 |
| 5,536,189 | 7/1996 | Mineo | 440/89 |
| 5,550,337 | 8/1996 | Tazaki et al. | 440/89 |
| 5,562,509 | 10/1996 | Nakase et al. | 440/89 |
| 5,572,943 | 11/1996 | Kobayashi et al. | 440/89 |

FOREIGN PATENT DOCUMENTS

| | | |
|---|---|---|
| 2-18193 | 1/1990 | Japan . |
| 2-85091 | 3/1990 | Japan . |

*Primary Examiner*—Jesus D. Sotelo

*Attorney, Agent, or Firm*—Knobbe, Martens, Olson & Bear, LLP

[57] ABSTRACT

A small watercraft includes an improved exhaust system that reduces the width of the engine and associated exhaust pipes. The watercraft includes a hull having a length in a longitudinal direction, a width in a lateral direction, and a longitudinal center line. A multi-cylinder engine is carried by the hull. The engine includes an exhaust system with multiple exhaust inlet ends and at least one downstream end. The exhaust inlet ends communicate with the respective cylinders of the engine. A flow axis through each inlet end extends in a direction generally parallel to the longitudinal axis of the hull. As a result, the exhaust system does not significantly protrude in a lateral direction beyond the sides of the engine. The hull consequently has a smaller width than the prior watercrafts which improves it maneuverability.

43 Claims, 9 Drawing Sheets

EXHAUST SYSTEM FOR SMALL WATERCRAFT

BACKGROUND OF THE INVENTION

1. Field of the Invention

This invention relates in general to a small watercraft, and in particular to an exhaust system for an engine of a small watercraft.

2. Description of Related Art

Personal watercrafts of the past had a relatively wide lower hulls. A personal watercraft includes an upper deck and a lower hull that form an engine compartment. The engine compartment houses an engine and a variety of related components for operation of the watercraft. The engine typically resides near the center of the watercraft partially disposed within a space between a pair of recessed foot areas of the upper deck. The space between the foot areas is designed to be sufficiently large to accommodate the engine and related components. One of these components is the exhaust manifold of the exhaust system. In the past, the exhaust manifold extended laterally from the engine in the cross direction of the hull. In order to accommodate the laterally extending exhaust manifold and engine, the lateral space between the foot areas had to be sufficiently large. As a result, the lower hull had to be made relatively wide to accommodate the large lateral space provided between the foot areas.

Generally, the wider the hull is, the wider the resulting turning radius of the watercraft will be. Consumers buy personal watercrafts for a number of reasons. One of the main reasons is the sporty nature of the personal watercraft. These watercrafts can be maneuvered much quicker and easier than most other types of watercrafts, contributing to their fun and excitement. In general, a wide lower hull makes it more difficult for an operator to lean the watercraft from side to side. This affects the turning performance because the lower hull includes outer chines that are designed to be dug into the water to facilitate turning. If an operator can not easily and quickly lean the watercraft towards a particular side, the chines do not have the opportunity to assist in the turn. As a result, the operator and watercraft experience long, slow, wide turns or large radius turns.

SUMMARY OF THE INVENTION

An aspect of the present invention lies in the recognition that reducing the width of the lower hull of a small watercraft improves the turning performance of the watercraft. The under surface of the lower hull includes a pair of outer chines. To assist in negotiating a turn, an operator leans the watercraft towards the side of the watercraft that the operator wants to turn to dig the respective outer chine of the hull into the water. The farther the chine is dug into the water, the sharper and quicker the respective turn. A narrower lower hull makes it easier to lean the watercraft from side to side to dig the chines into the water to facilitate a turn.

An additional aspect of the invention is adapted to be embodied in small watercraft having a hull with a length in a longitudinal direction and a width in a lateral direction. The hull includes a longitudinal center line. A multi-cylinder engine is carried by the hull. The engine includes an exhaust system with at least one exhaust inlet end. The at least one exhaust inlet end has an exhaust flow axis that extends generally parallel to the longitudinal center line of the hull in order to reduce the amount of lateral space occupied by the engine and the exhaust system and to decrease the width of the hull.

A further aspect of the invention is adapted to be embodied in a small watercraft having a hull with a length in a longitudinal direction and a width in a lateral direction. The hull includes a longitudinal center line. A multi-cylinder engine is carried by the hull. The engine includes an exhaust system with multiple exhaust conduit portions that extend behind the engine in the hull. By extending multiple exhaust conduit portions behind the engine, the weight of the exhaust conduit portions can be more symmetrically distributed with respect to the longitudinal center line for improving the weight balance in the watercraft.

A still further aspect of the invention is adapted to be embodied in a small watercraft that includes a hull having a length in the longitudinal direction and a width in the lateral direction. The hull includes a longitudinal center line. An in-line, multi-cylinder engine is carried by the hull. The engine includes a cylinder block with a plurality of cylinders angled partially in the lateral direction of the hull and an induction system angled partially in an opposite lateral direction of the hull. A longitudinally extending valley is formed between the partially angled cylinders and induction system. The engine includes an exhaust system with a plurality of exhaust inlet ends that directly communicate with the respective cylinders of the engine. The plurality of exhaust inlet ends have a corresponding plurality of exhaust flow axes that extend partially in the longitudinal direction of the hull. The exhaust system extends longitudinally forward, at least partially within the valley between the induction system and cylinders, and around and partially beneath the engine. This arrangement minimizes the amount of lateral space occupied by the engine and exhaust system so as to reduce the width of the hull.

BRIEF DESCRIPTION OF THE DRAWINGS

These and other features of the invention will now be described with reference to the drawings of preferred embodiments of the invention. The preferred embodiments of the invention shown and described are intended to illustrate, not limit, the invention. In the drawings.

DETAILED DESCRIPTION OF THE PREFERRED EMBODIMENTS OF THE INVENTION

Figure 1:
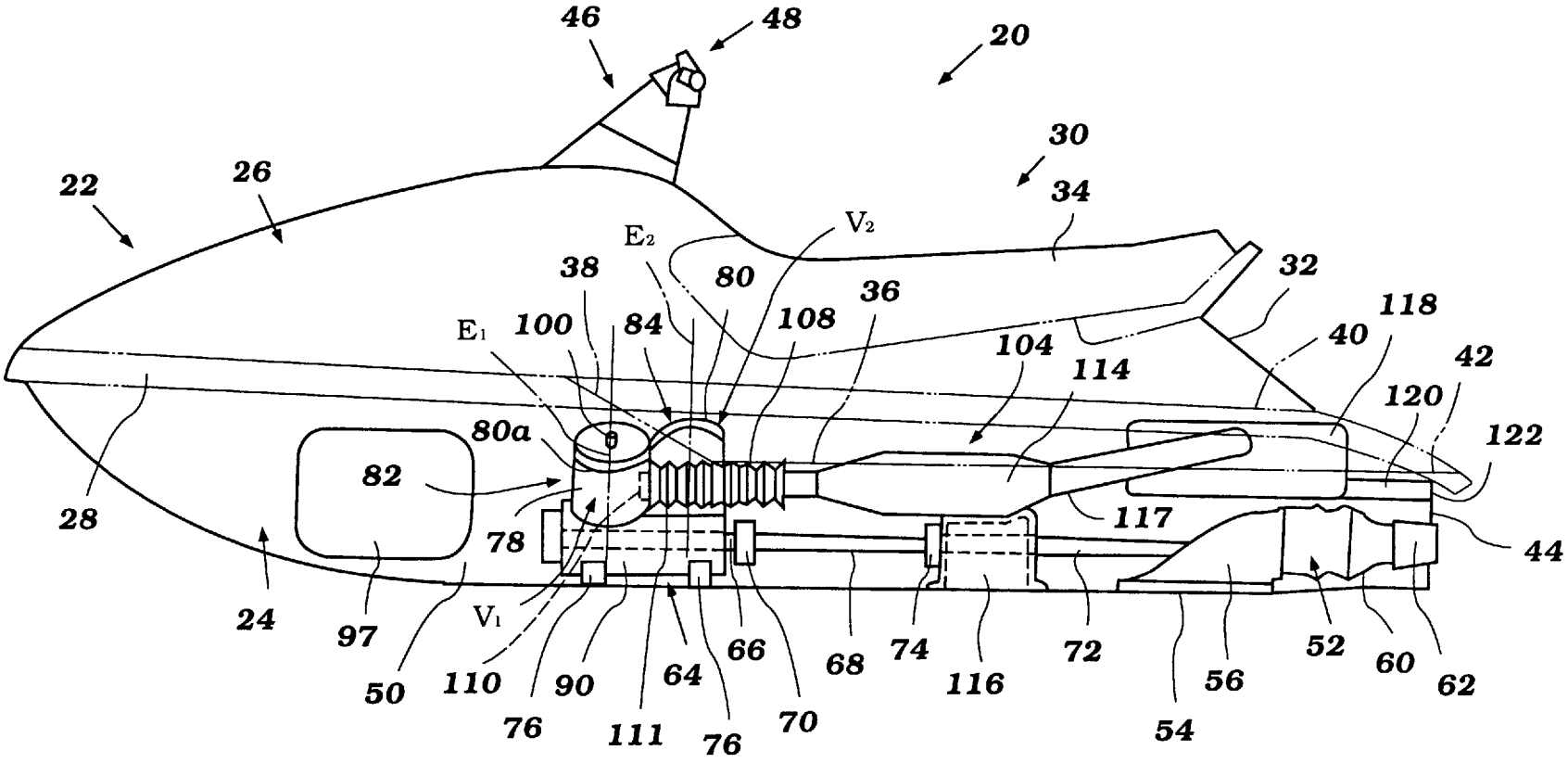
FIG. 1 is a side, partial sectional view of a personal watercraft constructed in accordance with an embodiment of the invention and shows a seat and portions of a hull in phantom.
Figure 2:
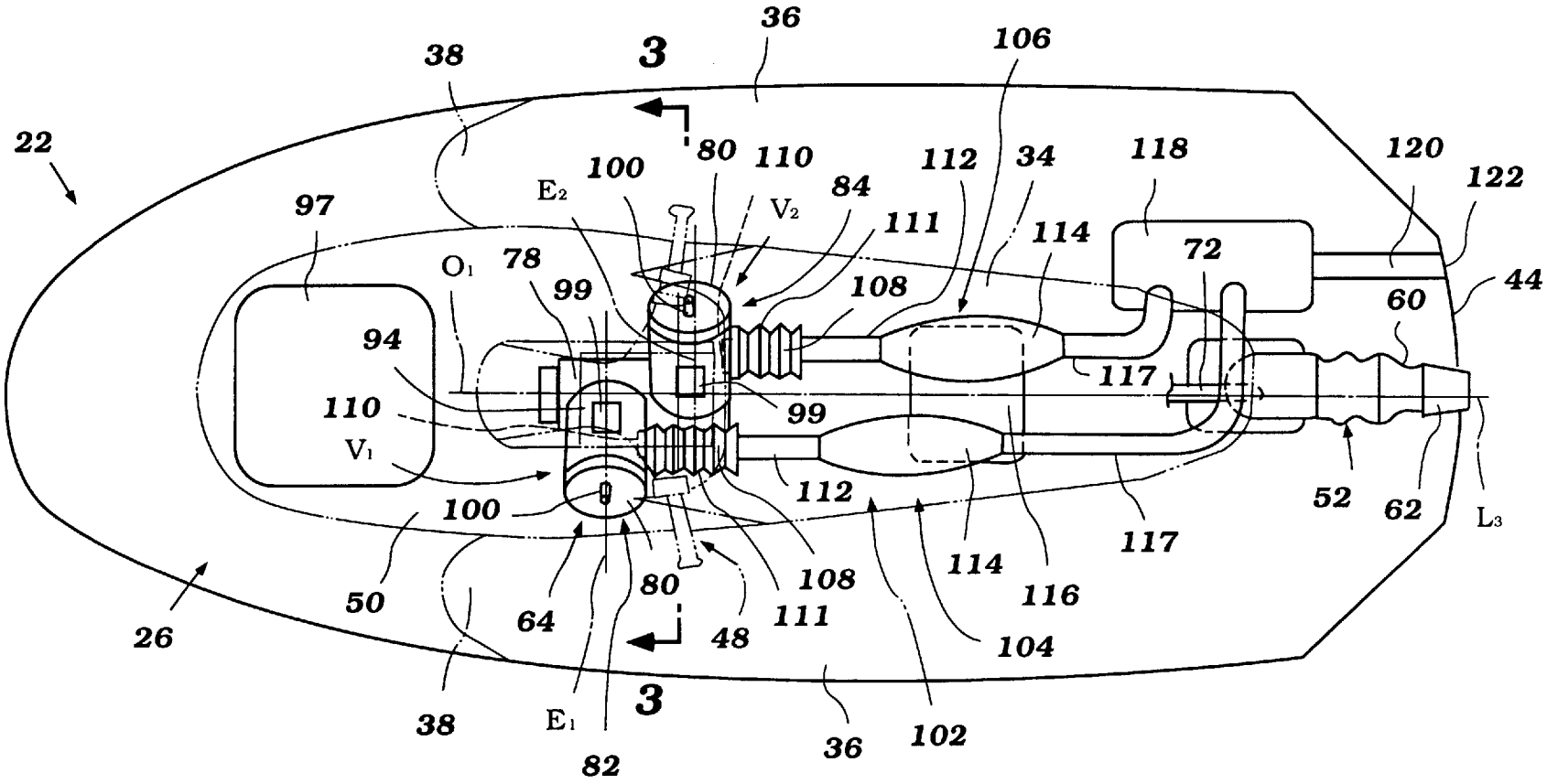
FIG. 2 is a top plan view of the personal watercraft of FIG. 1 and shows the seat and portions of the hull in phantom.
Figure 3:
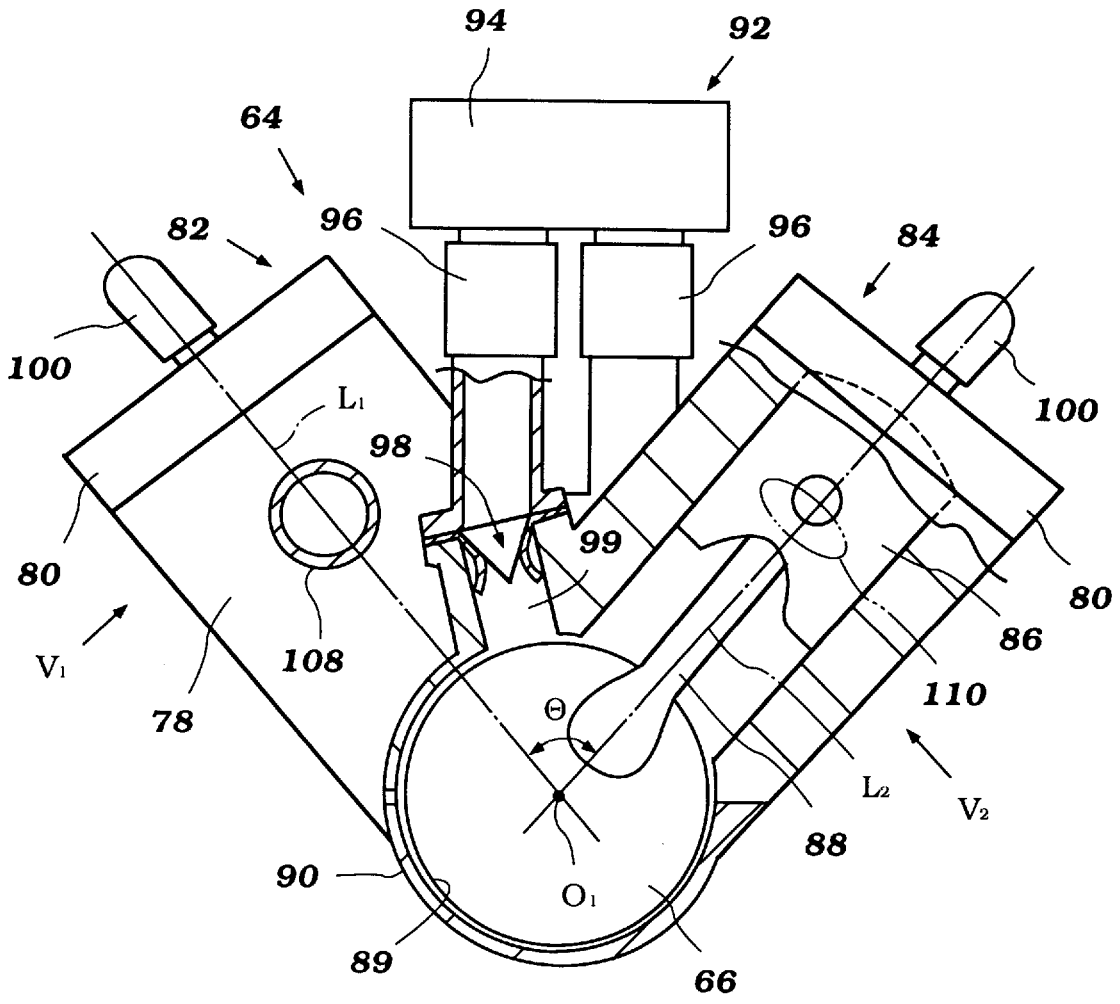
FIG. 3 is an enlarged cross-sectional view of an engine from the personal watercraft of FIGS. 1 and 2 taken along line 3—3 of FIG. 2.

With reference in detail to the drawings and initially to FIGS. 1–3, a personal watercraft constructed in accordance with an embodiment is identified generally by the reference numeral 20.

Although the present exhaust system is illustrated and described in connection with a personal watercraft, the exhaust system can be used with other types of watercraft as well, such as, for example, but without limitation, small jet boats and the like.

The personal watercraft 20 includes a hull, indicated generally by the reference numeral 22, which is made up primarily of a lower hull portion 24 and an upper deck portion 26. The lower hull portion 24 includes a pair of longitudinally extending outer chines 27 (See FIG. 7) to facilitate the tuning of the watercraft in a manner that will be described. The portions 24, 26 are formed from a suitable material such as a molded fiberglass reinforced resin or the like and are connected to each other in any known manner in this art. Normally, the connection is provided at an outstanding flange 28 which extends around the peripheral edge of the hull 22.

A rider's area 30 is provided in a rearward portion of the hull 22. The rider's area includes a raised pedestal 32 that is formed integrally with and extends from the upper deck 26. An upper surface of the raised pedestal 32 supports a removable seat 34. A sealing member 36 (FIG. 7) is provided around an engine access opening of the upper surface to inhibit water from entering an engine compartment, to be described, beneath the seat 34.

With reference back to FIGS. 1 and 2, a pair of sunken foot areas 36 are provided in the upper deck 26 on the sides of the raised pedestal 32 on which riders place their feet. The foot areas 36 are wide enough to sufficiently accommodate the riders' feet. The operator may place his or her feet on a pair of inclined front portions 38 at the front of the foot areas 36. The foot areas 36 are bounded on their outer sides by raised gunnels 40 which protect the lower legs of the riders. The beam of the watercraft is used herein to mean the lateral distance between the raised gunnels 40. As will be discussed in more detail below, the beam of the watercraft affects the turning performance of the watercraft and is largely determined by the lateral distance provided between the foot areas 36. The foot areas 36 open into a boarding platform 42 near a transom 44 of the watercraft. The boarding platform 42 aids the riders in boarding the watercraft from the rear.

A control area 46 is provided at a forward part of the rider's area 30. The control area 46 includes a handlebar assembly 48 for steering the watercraft in a manner which will be described. The control area 46 preferably also includes a variety of other well-known watercraft controls for operating the watercraft.

Below the upper deck 26, the lower hull 24 and upper deck 26 define an engine compartment 50. Vents (not shown) communicate with the engine compartment 50 to allow atmospheric air into the compartment 50 for cooling and combustion purposes, as is well known in the art. A jet propulsion unit, indicated generally by the reference numeral 52, is provided at a rear part of this compartment 50. The jet propulsion unit 52 includes a jet pump housing that forms a water inlet opening 54 and a water duct 56. An impeller (not shown) draws water through the water inlet opening and water duct 56. The impeller in turn discharges the water rearwardly to a discharge nozzle portion 60 upon which a steering nozzle 62 is pivotally mounted. The steering nozzle 62 is coupled to the handlebar assembly 48 for pivotal movement of the steering nozzle about a vertically extending steering axis for controlling the direction that the watercraft travels.

The impeller is driven by an engine, indicated generally by the reference numeral 64, through a drive assembly. The drive assembly includes a crankshaft or output shaft 66 that drives an intermediate shaft 68 through a coupling 70. The intermediate shaft 68 is coupled to an impeller shaft 72, which is journaled for rotation within a bearing 74, for driving the impeller shaft 72. The impeller is fixed to one end of the impeller shaft 72.

With reference to FIGS. 1–3, and especially FIG. 3, the engine 64 is mounted within the engine compartment 50 to the lower hull 24 with elastic engine mounts 76. The engine 64 is located partially below a front portion of the seat 34 and along a longitudinal center line L3 of the hull 22. The engine 64 is provided at this location in order to balance the weight of the engine 64 since the heavy weight of the engine 64 affects the balance of the watercraft.

The engine 64 illustrated is a two-cylinder, V-type engine operating on a two-troke, crankcase-compression principle. This type of engine is particularly desirable for use in a personal watercraft because it is relatively small in size, produces a relatively high output, and provides good weight balance for itself and its related components.

The engine 64 includes a cylinder block 78 and a pair of cylinder heads 80. The cylinder heads 80 and an upper portion of the cylinder block 78 form a pair of inclined cylinder banks V1, V2. The cylinder banks V1, V2 are provided at an angle θ from each other and lie at an angle in the vertical and lateral direction of the hull 22 partially within the space between the foot areas 36. The cylinder banks V1, V2 each form a respective cylinder 82, 84. As shown in FIGS. 1–3, the cylinders 82, 84 each include respective longitudinal center lines L1, L2. Each cylinder includes a cylinder bore in which respective pistons 86 reciprocate along the longitudinal center lines L1, L2.

A connecting rod 88 connects the reciprocating pistons 86 to the crankshaft 66 for rotating the crankshaft 66 in a well-known manner. The crankshaft 66 rotates about a rotational axis O1 that lies in the same vertical plane as the longitudinal center line of the hull L3. It should be noted, the rotational axis of the crankshaft O1 forms the effective vertex of the cylinder center lines L1, L2. In other words, the cylinders 82, 84 are arranged so that the center lines L1, L2 intersect the rotational axis O1. The aforementioned angle θ between the cylinder banks V1, V2 is the same as the effective angle formed between these center lines L1, L2 from their intersection with the rotational axis O1. The cylinders 82, 84 also include a pair of respective planes E1, E2 formed by a pair of respective planes perpendicular to the rotational axis O1 and containing center lines L1, L2, respectively. The longitudinal center line L2 and plane E2 of the rear cylinder 84 are located behind the longitudinal center line L1 and plane E1 of the front cylinder 82.

Each crankshaft 66 is rotatably journaled within a respective crankcase chamber 89. The crankcase chambers 89 are formed by the cylinder block 78 and a detachable crankcase member 98. The cylinder block 78 includes a lower portion with a skirt that forms the upper part of the crankcase chambers 89. The crankcase member 98, is detachably secured to the skirt of the cylinder block 78 to form the lower part of the crankcase chambers 89.

The engine 64 includes an induction system, indicated generally by the reference numeral 92, located partially between the cylinder banks V1, V2. The induction system 92 includes an air intake silencer 94 into which air flows from the engine compartment 50. An air charge flows from the intake silencer 94 to a charge former. In the illustrated embodiment, the charge former is a carburetor assembly that includes a pair of carburetors 96. The carburetors 96 receive fuel from a fuel tank 97 located in front of the engine 64. The carburetors 96 add this fuel to the air charge already received. The resultant fuel-air charge flows from the carburetors 96 to the respective crankcase chambers 89 through a reed-valve assembly 98 located in the lower portion of the cylinder block 78. As is well-known in this art, the reed-valve assembly permits air to flow into the crankcase chambers 89 through intake passages 99 formed in the lower portion of the cylinder block 78 when the corresponding piston 86 moves toward top dead center, but precludes reverse flow when the piston 86 moves toward bottom dead center to compress the charge delivered to the crankcase chamber 89.

As is well known in the two-cycle engine practice, the crankcase chambers 89 of the engine 64 are sealed from each other and communicate with respective combustion chambers of the cylinders 82, 84 through a series of scavenge passages (not shown) located in the cylinder block 78. When the piston 86 moves toward bottom dead center, the fuel-air charge in the crankcase chamber 89 is forced through the scavenge passages into the respective combustion chamber. The fuel-air charge in the combustion chamber is ignited by a spark plug 100 provided in the cylinder head 80. Combustion occurs and the resulting exhaust gases are expelled through an exhaust system, indicated generally by the reference numeral 102.

As best seen in FIG. 2, the exhaust system 102 includes a pair of generally longitudinally oriented exhaust pipes 104, 106. Each exhaust pipe 104, 106 includes a rubber exhaust hose or bellow 108 that communicates with an exhaust port 110 formed in a rear part of the respective cylinders 82, 84. The exhaust hose 108 includes an exhaust inlet end 111 through which exhaust gases first flow through when entering the exhaust system 102. The exhaust inlet end 111 includes an exhaust flow axis through the center of the exhaust inlet end 111. The exhaust flow axis of the exhaust inlet end 111 is skewed relative to the respective cylinder plane E1, E2. As used herein, "skewed" means that the exhaust flow axis is provided at a position that falls out of the respective plane E1, E2, even perpendicular to the respective plane E1, E2. In other words, the exhaust flow axis is not parallel to the respective cylinder plane E1, E2. In the embodiment of FIGS. 1–3, the exhaust flow axis is skewed relative to the cylinder plane E1, E2 so that it lies generally parallel to the rotational axis O1 of the crankshaft and the longitudinal center line L3 of the hull and generally perpendicular to the cylinder plane E1, E2. The exhaust hoses 108 extend longitudinally and rearwardly from the cylinders 82, 84.

An exhaust conduit 112 connects each exhaust hose 108 with a corresponding exhaust expansion chamber 114. The expansion chambers 114 can include a catalytic device for treating hydrocarbons in the exhaust and rendering them harmless. Because the expansion chambers 114 are relatively heavy, an expansion chamber support 116 is provided beneath the expansion chambers 114 for supporting the expansion chambers 114.

The exhaust pipes 104, 106 are generally symmetrically disposed from the exhaust hoses 108 to the expansion chambers 114 with respect to the longitudinal center line L3 of the hull 22. The exhaust pipes 104, 106 also include corresponding exhaust flow axes that are symmetrically located with respect to said longitudinal center line L3. Symmetrically orienting the exhaust pipes 104, 106 with respect to the longitudinal center line L3 is desirable because the exhaust system components are relatively heavy and the symmetric arrangement of the components on the sides of the center line L3 improves the balance in the watercraft.

An exhaust conduit 117 connects each expansion chamber 114 with a single water trap device or water lock 118. The water trap device 118 is located above and to the side of a tunnel (not shown) that houses the jet propulsion unit 52. As is well known in the art, the water trap device 118 is sized so as to provide a sufficient volume to retain water and preclude it from flowing into the engine 64. In addition, internal baffles may be provided in the water trap device 118 for further water preclusion.

An exhaust conduit 120 connects the water trap device 118 with a discharge or downstream end 122 of the exhaust system 102 for expelling exhaust gases from the exhaust system 102. The discharge end 122 is provided at the transom 44 of the watercraft at an elevation that normally lies at or below the water line. It is advantageous to discharge the exhaust products at this point for silencing exhaust noise. The discharge end 122 of the exhaust conduit 120 may also be provided in the aforementioned tunnel in order to discharge exhaust gases at that location.

By orienting the exhaust system 102 so that the exhaust flow axis of the exhaust inlet end 111 is generally parallel with the longitudinal center line L3 of the hull 22, the exhaust system 102 does not occupy additional lateral space between the foot areas 36 in addition to that occupied by the engine 64. As a result, the lateral distance between the foot areas 36, and, hence, the width of the lower hull 24, is reduced compared to watercrafts of the past.

Figure 7:
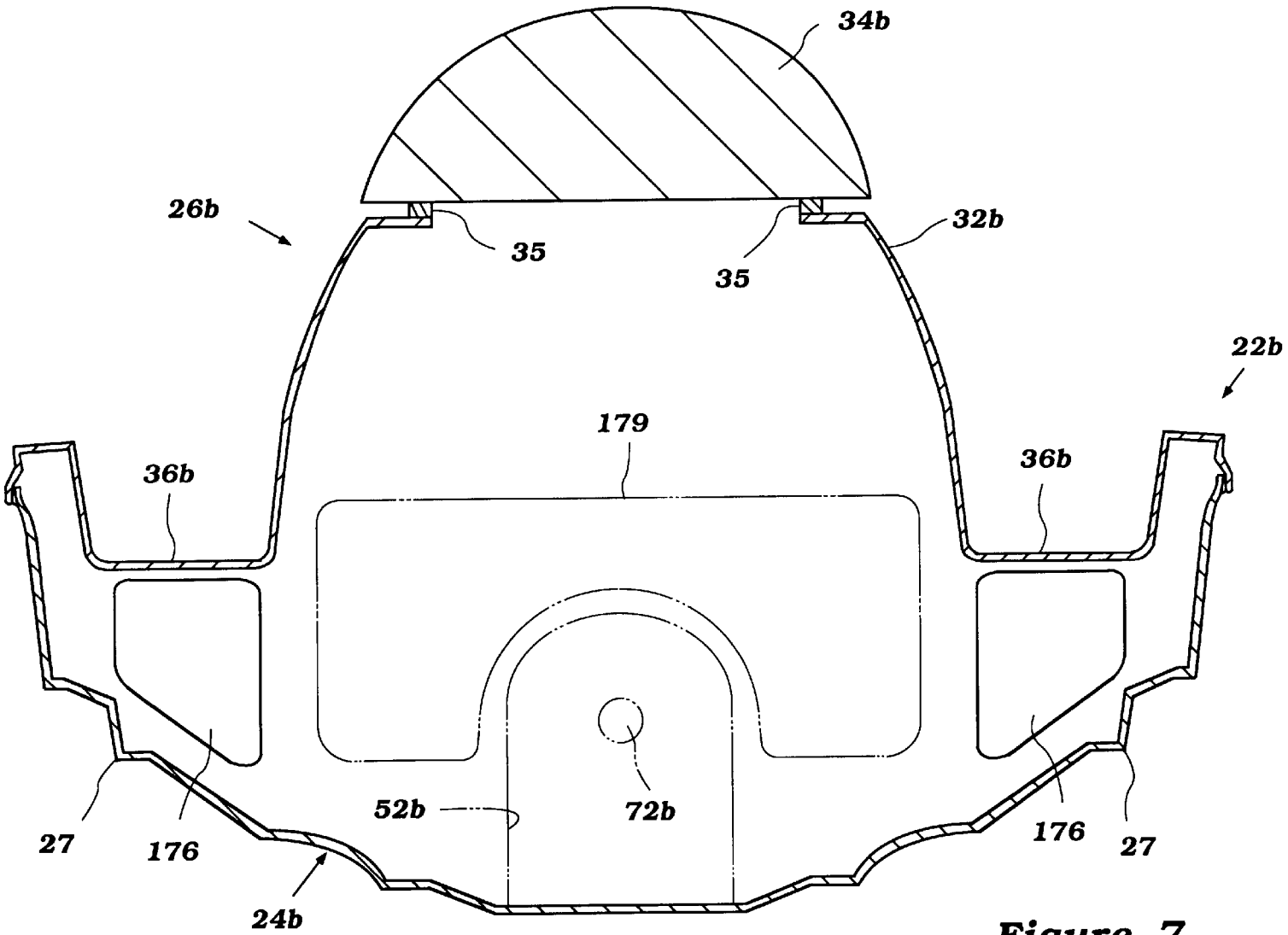
FIG. 7 is an modified, enlarged cross-sectional view of the personal watercraft of FIGS. 5 and 6 taken along line 7—7 of FIG. 6 and shows a modified fuel tank in an alternative location in the personal watercraft.

As mentioned above, the lower hull 24 includes a pair of outer chines 27 (FIG. 7). To assist in negotiating a turn, an operator leans the watercraft towards the side of the watercraft that the operator wants to turn to dig the respective outer chine 27 of the lower hull 24 into the water. The farther the chine is dug into the water, the sharper and quicker the respective turn. A narrower lower hull 24 makes it easier to lean the watercraft from side to side to dig the chines 27 into the water to facilitate a turn. This makes it easier to negotiate sharp, quick turns.

Figure 4:
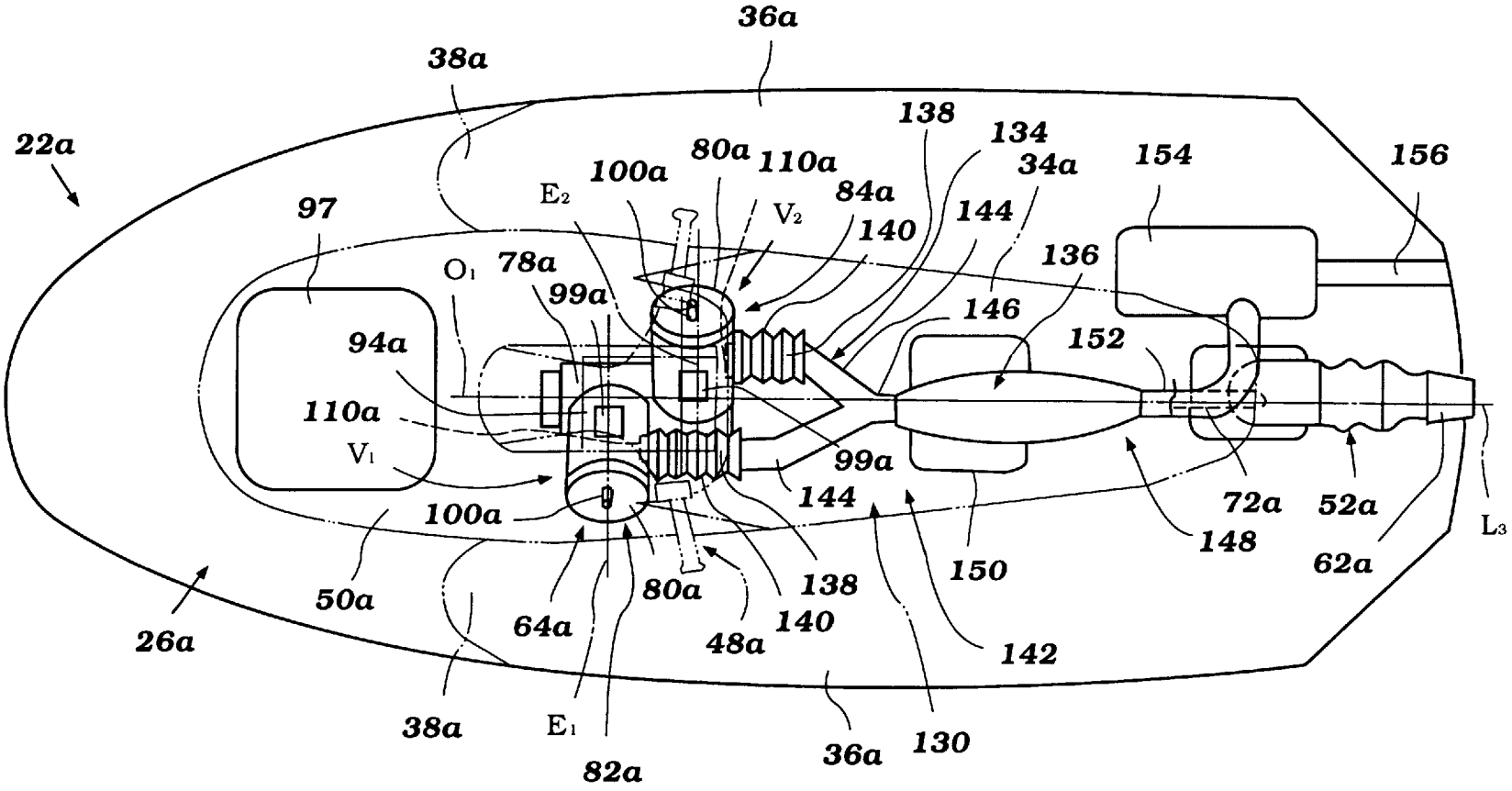
FIG. 4 is a top plan view of a personal watercraft constructed in accordance with an additional embodiment of the invention and shows a seat and portions of a hull in phantom.

With reference to FIG. 4, another embodiment of the invention will be described. To facilitate an understanding of the invention, an "a" suffix has been added to the reference numbers of those parts in FIG. 4 that are similar to the parts of the embodiment described above.

An exhaust system, indicated generally by the reference number 130, includes a pair of exhaust pipes 132, 134 that merge into a single exhaust pipe 136. The exhaust pipes 132, 134 each include a rubber exhaust hose or bellow 138. Each exhaust hose 138 includes an exhaust inlet end 140 that communicates with the respective exhaust outlet port 110*a* of the respective cylinders 82*a*, 84*a*. Exhaust gases first flow through the exhaust inlet end 140 when entering the exhaust system 102. The exhaust inlet end 140 includes an exhaust flow axis through the center of the exhaust inlet end 140. The exhaust flow axis is skewed relative to the respective cylinder plane E1, E2. In the embodiment of FIG. 4, the exhaust flow axis of the exhaust inlet end 140 is skewed so that it lies generally parallel to the rotational axis O1 of the crankshaft and longitudinal center line L3 of the hull and generally perpendicular to plane E1, E2. A branched exhaust conduit 142 includes a pair of conduit branches 144 that communicate with the respective exhaust hoses 138. The branched exhaust conduit 142 includes a single conduit 146 at an opposite part of the branched exhaust conduit 142 from the conduit branches 144.

The branched exhaust conduit 142 is generally symmetrically disposed with respect to the longitudinal center line L3 of the hull. The single conduit 146 communicates with an exhaust expansion chamber 148. The exhaust expansion chamber 148 lies generally in the longitudinal center line L3 of the hull 22, and rests upon an expansion chamber support 150. The branched exhaust conduit 142 and the exhaust expansion chamber 148 include corresponding exhaust flow axes that are generally symmetrically located with respect to the longitudinal center line L3 of the hull. Because the exhaust system 130 is relatively heavy, especially the expansion chamber 148, symmetrically orienting the branched exhaust conduit 142 and providing the expansion chamber 148 in the longitudinal center line L3 of the hull helps improve the balance in the watercraft.

An exhaust conduit 152 connects the expansion chamber 148 with a water trap device 154 similar to the water trap device described above. An exhaust conduit 156 connects the water trap device 154 with the transom 44*a* of the watercraft for expelling exhaust gases from the exhaust system 130 in the manner described above. By orienting the exhaust flow axis of the exhaust inlet end 140 so that it is generally parallel with the longitudinal center line L3 of the hull, the exhaust system 130 does not occupy additional lateral space between the foot areas 36*a* in addition to that occupied by the engine 64*a*. As a result, the lateral distance between the foot areas 36*a*, and, hence, the width of the lower hull 24*a*, is reduced compared to watercrafts of the past. As mentioned above, this improves the turning performance of the watercraft.

Figure 5:
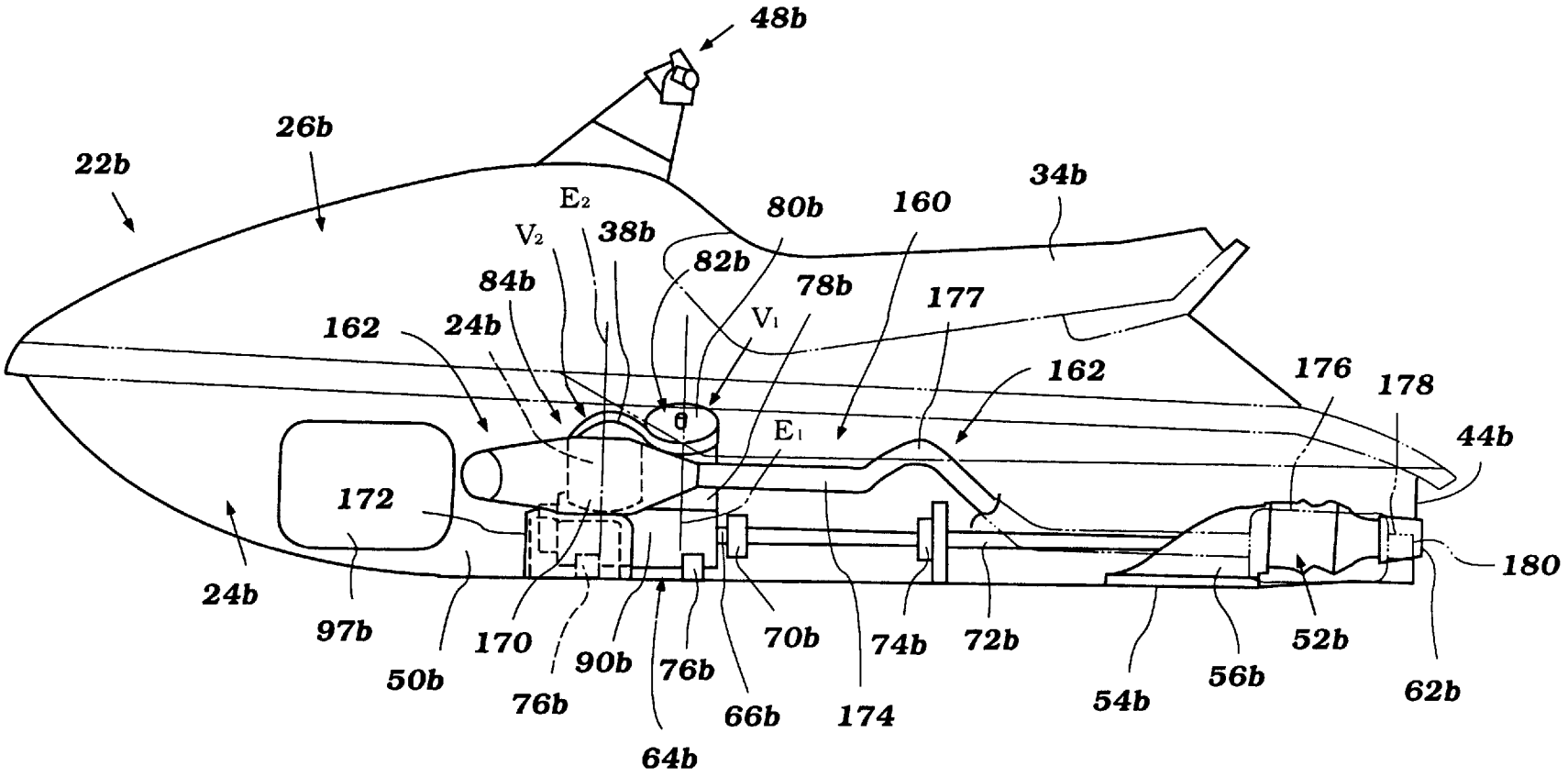
FIG. 5 is a side, partial sectional view of a personal watercraft constructed in accordance with a further embodiment of the invention and shows a seat and portions of a hull in phantom.
Figure 6:
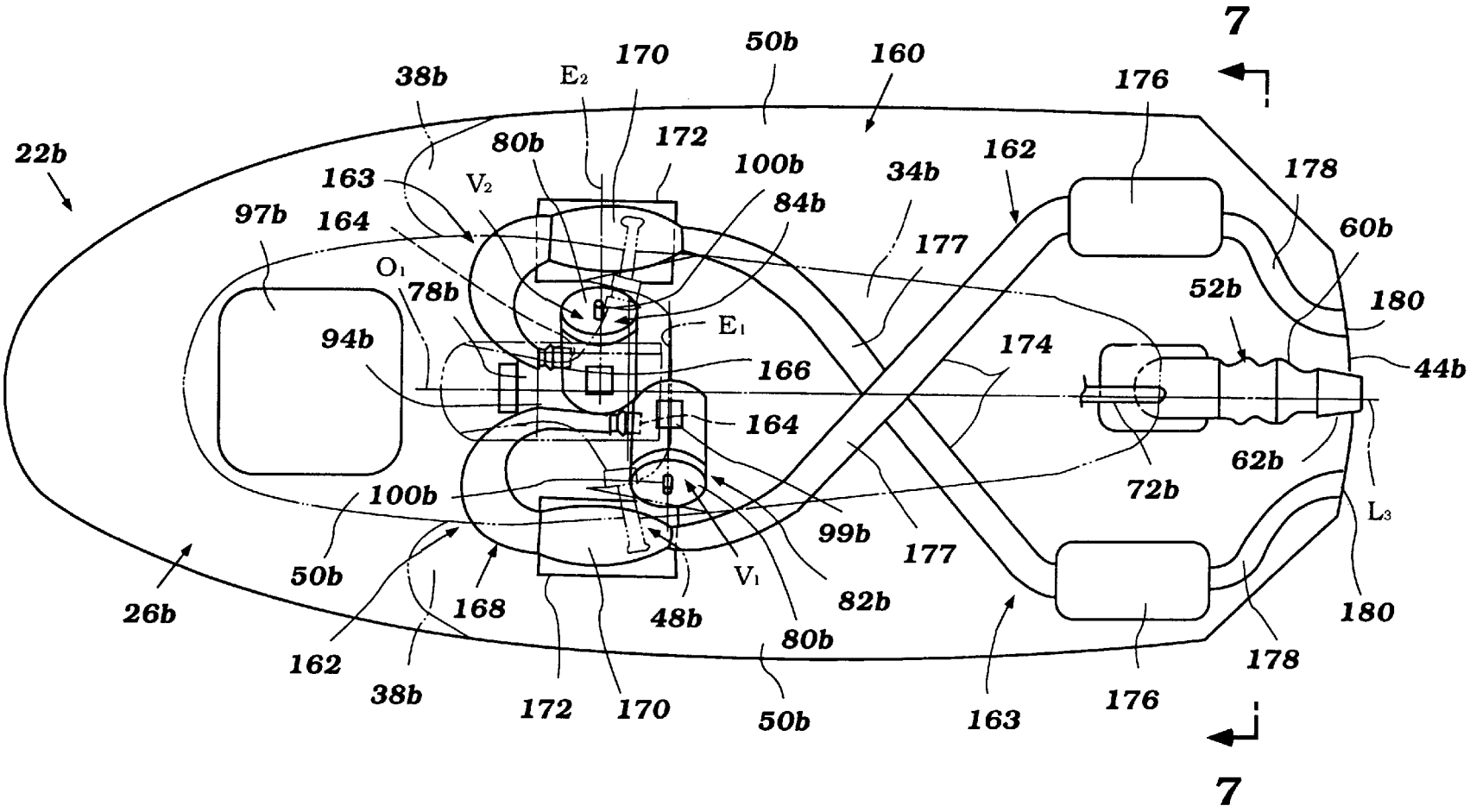
FIG. 6 is a top plan view the personal watercraft of FIG. 5 and shows the seat and portions of the hull in phantom.

With reference to FIGS. 5–7, an additional embodiment of the invention will now be described. To facilitate an understanding of the invention, a "b" suffix has been added to the reference numbers of those parts in FIGS. 5–7 that are similar to the parts of the embodiments described above.

An exhaust system, indicated generally by the reference numeral 160, includes a pair of exhaust pipes 162, 163 that extend from the front of the cylinders 82*b*, 84*b*. The exhaust pipes 162, 163 include respective rubber exhaust hoses 164. The rubber exhaust hoses 164 include corresponding exhaust inlet ends 166 that communicate with respective exhaust outlet ports 165 located on a front side of the corresponding cylinders 82*b*, 84*b*. Exhaust gases first flow forwardly through the exhaust inlet ends 166 when entering the exhaust system 160. The exhaust inlet ends 166 include respective exhaust flow axes through the center of the exhaust inlet ends 166. The exhaust flow axes are skewed with respect to the cylinder planes E1, E2. In the embodiment of FIGS. 6 and 7, the exhaust flow axes are skewed so that they lie generally parallel with the rotational axis O1 of the crankshaft and the longitudinal center line L3 and of the hull and generally perpendicular to the respective plane E1, E2. A pair of corresponding C-shaped pipe sections 168 connect the rubber hoses 164 with respective expansion chambers 170 similar to the expansion chambers described above. Each expansion chamber 170 rests upon an expansion chamber support 172.

Although this embodiment of the exhaust system of the present invention extends more laterally in the cross-direction of the hull than the aforementioned embodiments, the C-shaped pipe sections 168 and expansion chambers 170 do not significantly extend within the lateral space between the foot areas 36*b* because these components lies to the sides, partially below the cylinder banks V1, V2. Consequently, these components do not meaningfully affect the width of the lower hull 24*b*.

A pair of exhaust conduits 174 connect the expansion chambers 170 with a pair of respective water trap devices 176. The exhaust conduits 174 extend at an angle across the hull and cross each other near the longitudinal center line L3 of the hull 22*b*. A vertical crook 177 is provided near where the exhaust conduits 174 cross each other for inhibiting the ingress of water into the engine 64*b*.

This orientation of the exhaust conduits 174 allows a significant amount of free space in the engine compartment 50*b* between the jet propulsion unit 52*b* and the engine 64*b*. With reference to FIG. 7, in an alternative embodiment of the invention, a fuel tank 179 having a longitudinally incurved portion, to accommodate the housing of the jet propulsion unit 52*b*, may be disposed in the free space between the engine compartment 50*b* and the jet propulsion unit 52*b*. The fuel tank 179 is symmetrically disposed with respect to said longitudinal center line of the hull L3.

A pair of exhaust conduits 178 connect the water trap devices 176 with a pair of exhaust discharge or downstream ends 180 located in the transom 44*b* of the watercraft in a manner similar to that described above.

The exhaust pipes 162, 163 are symmetrically disposed with respect to the longitudinal center line L3 of the hull. In addition, the exhaust pipes include respective exhaust flow axes that are symmetrically located with respect to the longitudinal center line L3 of the hull. As mentioned above, symmetrically orienting the exhaust components improves the balance in the watercraft.

The exhaust pipes 162, 163 have an exaggerated exhaust path compared to exhaust paths of engines in the past. The exaggerated length of the exhaust pipes allows tuning of the length of the exhaust paths to improve exhaust scavenging in the engine.

In addition, by orienting the exhaust flow axis of the exhaust inlet ends 166 so that they are generally parallel with the longitudinal center line L3 of the hull, the exhaust system 160 does not occupy any meaningful additional lateral space between the foot areas 36*b* in addition to that occupied by the engine 64*b*. As a result, the lateral distance between the foot areas 36*b*, and, hence, the width of the lower hull 24*b*, is reduced compared to watercrafts of the past. As mentioned above, this improves the turning performance of the watercraft.

Figure 8:
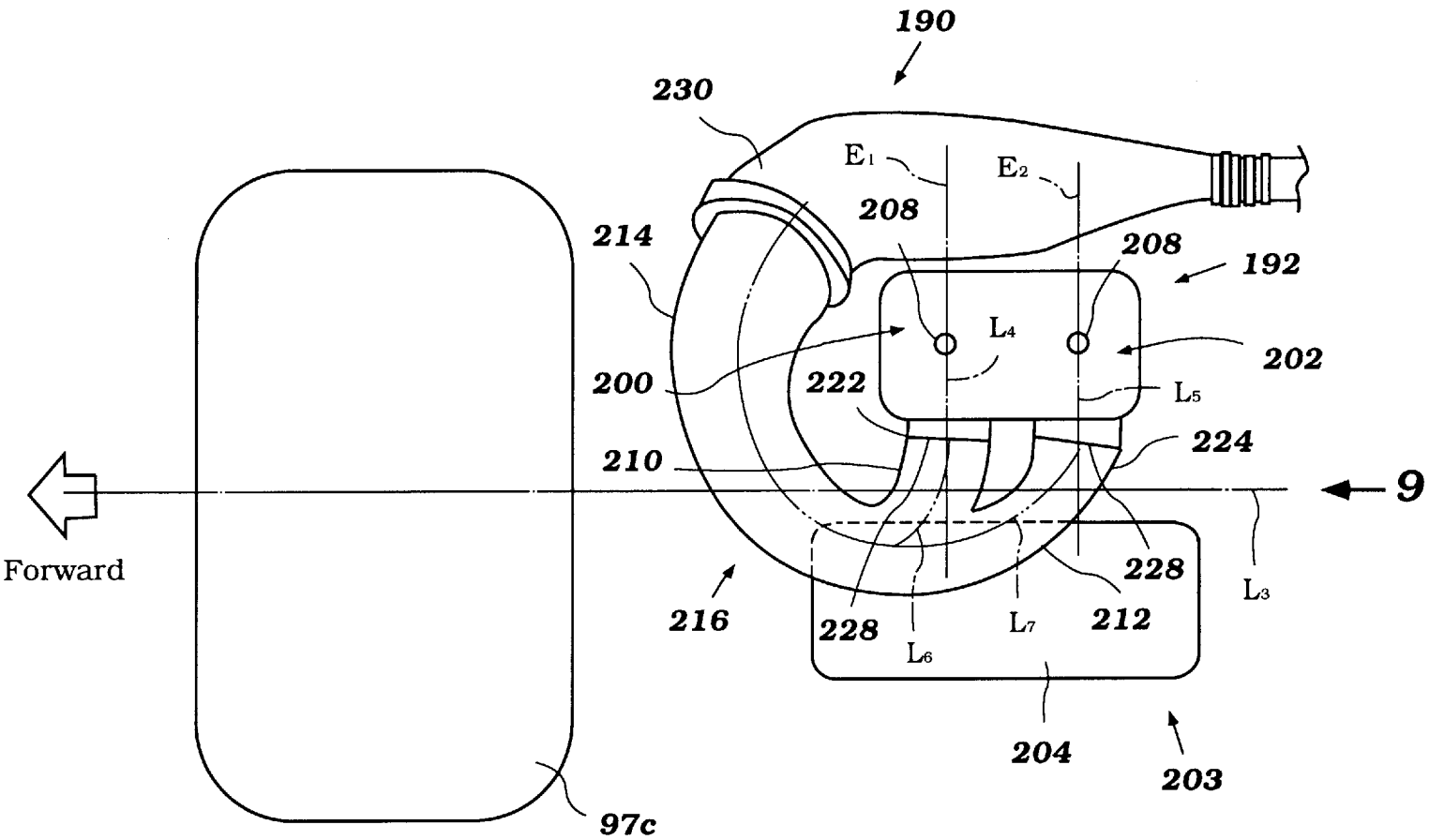
FIG. 8 is a top plan view of an engine and an exhaust system constructed in accordance with additional embodiment of the invention and shows an arrow indicating the forward direction of the watercraft.
Figure 9:
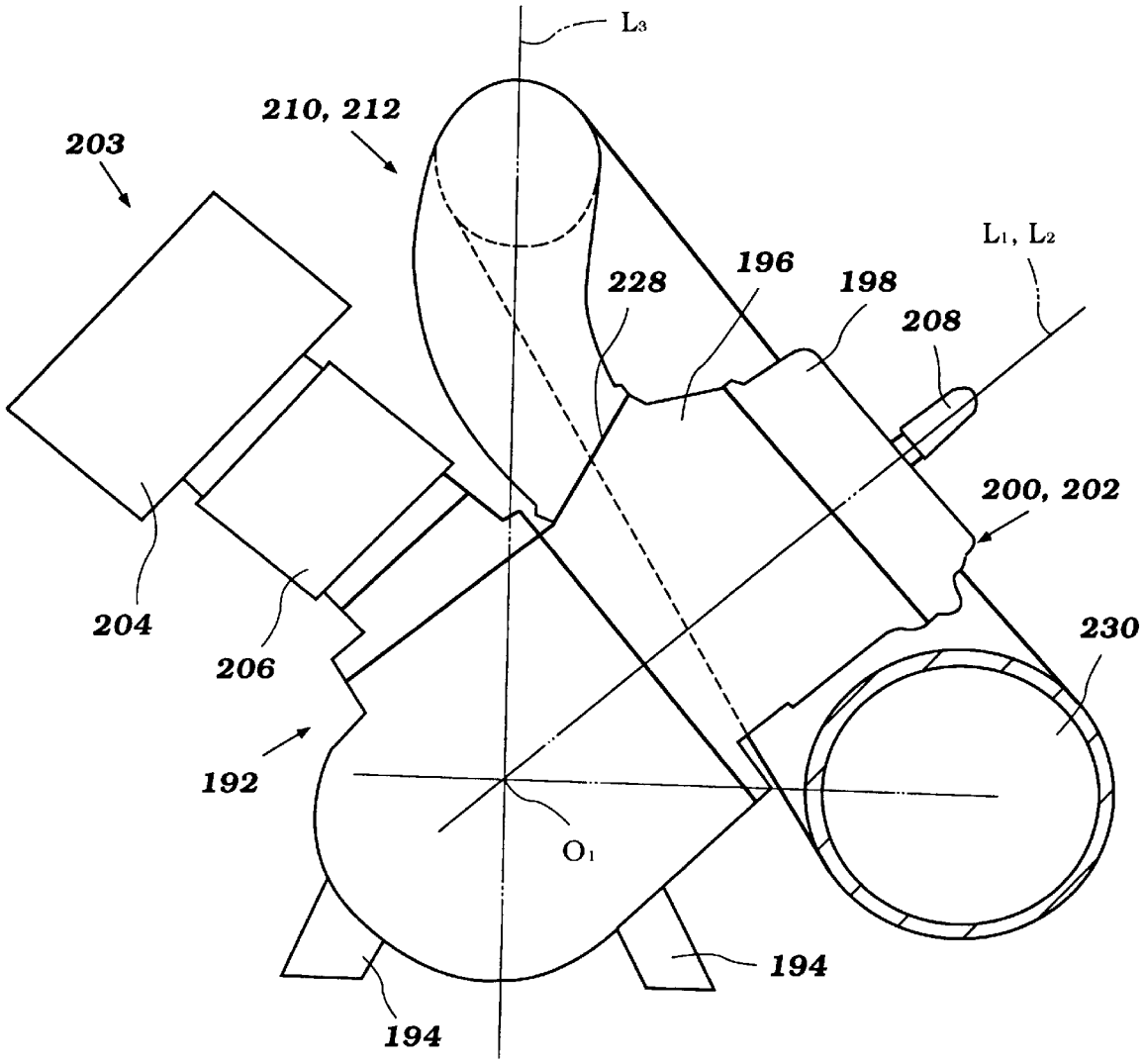
FIG. 9 is an end view of the engine and the exhaust system of FIG. 8 taken along line 9 of FIG. 8.

With reference to FIGS. 8 and 9, an additional embodiment of the invention will now be described. To facilitate an understanding of the invention, a "c" suffix has been added to the reference numbers of those parts in FIGS. 8 and 9 that are similar to the parts of the embodiments described above.

FIGS. 8 and 9 illustrate an exhaust system 190 and engine 192 constructed in accordance with an additional embodiment of the invention. The engine 192 illustrated is an engine of the two-cylinder, in-line type operating on a two-stroke, crankcase-compression principle. The engine 192 is mounted with engine mounts 194 behind a fuel tank 97*c* in approximately the same location in a personal watercraft as the engines described above.

The engine 192 includes a cylinder block 196 and cylinder head 198. An upper part of the cylinder block 196 and the cylinder head 198 form a pair of cylinders 200, 202 inclined in the lateral and vertical direction of the hull. The cylinders 200, 202 include longitudinal center lines L1, L2, respectively, along which a pair of respective pistons (not shown) reciprocate to drive a crankshaft (not shown) in a well-known manner. The crankshaft rotates about a rotational axis O1 defined by the crankshaft. A pair of cylinder planes E1, E2 extend through the cylinders 200, 202. The cylinder planes are defined by a pair of respective planes that contain center lines L1, L2 and extend perpendicularly to the rotational axis O1.

The crankshaft is rotatably journaled within a pair of crankcase chambers. The crankcase chamber is formed by the skirt of a lower portion of the cylinder block 196 and a detachably secured crankcase member 204.

An induction system 203 delivers an fuel-air charge to the engine 192. The induction system 203 is inclined in the lateral and vertical direction of the hull in an opposite direction than the cylinders 200, 202. The area between the inclined induction system 203 and cylinders 200, 202 forms a valley. The induction system 203 includes an air intake silencer 204 into which air flows air flows form the engine compartment. The air intake silencer 204 provides an air charge to a pair of carburetors 206 which, in turn, supply a fuel-air charge to the respective crankcase chambers. The fuel-air charge is transferred from each crankcase chamber to a respective combustion chamber of they cylinders 200, 202 through a series of scavenge passage formed in the upper portion of the cylinder block 196. In the combustion chamber, the fuel-air charge is ignited by a spark plug 208 provided in the cylinder head 198. After combustion of the fuel-air charge, the exhaust gases are expelled to the exhaust system 190.

The exhaust system 190 includes a pair of exhaust pipes 210, 212 that merge into a single exhaust pipe 214. Together, the exhaust pipes 210 and single exhaust pipe 214 form a branched exhaust pipe 216. The exhaust pipes 210, 212 terminate in a corresponding pair of exhaust inlet ends 222, 224. The exhaust inlet ends 222, 224 of the branched exhaust pipe 216 communicate with respective exhaust outlet ports 228 of the cylinders 200, 202. The exhaust outlet ports 228 include a pair of respective center lines L4, L5 and the exhaust inlet ends 222, 224 include a pair of respective exhaust flow axes L6, L7. The exhaust flow axes L6, L7 of the exhaust inlet ends 222, 224 coincide with the center lines L4, L5 of the exhaust ports 228 near where the exhaust inlet ends 222, 224 intersect the exhaust outlet ports 228. The exhaust inlet ends 222, 224 and respective exhaust flow axes L6, L7 are skewed at least slightly relative to the respective cylinder planes E1, E2. In the embodiment of FIGS. 8 and 9, the exhaust flow axes L6, L7 are skewed so that the flow axes L6, L7 extend at least slightly forward in the longitudinal direction.

The branched exhaust pipe 216 has a "C" shape and extends forwardly through the valley between the induction system 203 and the cylinders 200, 202 of the engine 192 and outwardly and rearwardly between the engine 192 and the fuel tank 97*c*. An expansion chamber 230 is connected to the single exhaust pipe 214 and resides along the side of the engine 192, partially below the cylinders 200, 202. By providing the expansion chamber in this location, heat transfer from the expansion chamber 230 to the fuel of the fuel tank 97*c* is inhibited. The remainder of the exhaust system 190 is not shown and described because it does not form a part of the present invention. As a result, the remainder of the exhaust system may take any well known form in the art.

By skewing the exhaust flow axes L6, L7 and the exhaust inlet ends 222, 224 relative to the cylinder planes E1, E2 and providing the branched exhaust pipe 216 within the valley between the induction system 203 and cylinders 200, 202 of the engine 192, the embodiment of FIGS. 8 and 9 minimizes the lateral space occupied by the engine 192 and the exhaust system 190. Minimizing the lateral space occupied by these components allows the lower hull to be made narrower than in the past. As mentioned above, a narrower lower hull improves the turning performance of the watercraft.

As common to each of the embodiments described above, a means is provided for discharging exhaust gases from the engine while reducing the overall width of the engine and the associated exhaust system. Reducing the width of the engine and exhaust system allows a narrower lower hull, which improves the turning performance of the watercraft.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A small watercraft comprising a hull having a length in a longitudinal direction and a width in a lateral direction, the hull including a longitudinal center line, a multi-cylinder engine carried by said hull, an exhaust system including at least one exhaust inlet end directly communicating with a respective cylinder of said engine, and said at least one exhaust inlet end having an exhaust flow axis extending in a direction generally parallel to the longitudinal center line of the hull.

2. The small watercraft of claim 1, wherein said engine is a V-type engine having a pair of cylinder banks angled partially in the lateral direction of the hull.

3. The small watercraft of claim 2, further including an induction system for said engine at least partially disposed between said cylinder banks.

4. The small watercraft of claim 1, wherein said exhaust system comprises multiple exhaust sections that communicate directly with the respective cylinders of said engine, at least part of said exhaust sections extending rearwardly of said engine, and each of said exhaust sections having a respective exhaust flow axis that is symmetrically located with respect to said longitudinal center line.

5. The small watercraft of claim 4, wherein said exhaust sections comprise a pair of exhaust conduits each exhaust conduit extends from a rear part of said cylinder.

6. The small watercraft of claim 5, wherein each of said exhaust sections includes an expansion chamber.

7. The small watercraft of claim 6, wherein a support is provided for said expansion chambers.

8. The small watercraft of claim 5, wherein at least one water trap device communicates with said exhaust sections.

9. The small watercraft of claim 5, wherein said exhaust system includes at least one discharge end at a transom of the watercraft.

10. The small watercraft of claim 5, wherein said exhaust system includes an expansion chamber located in the longitudinal center line of the hull.

11. The small watercraft of claim 10, wherein a support is provided for said expansion chamber.

12. The small watercraft of claim 4, wherein said exhaust sections comprise a pair of exhaust conduits wherein each exhaust conduit extends from a front part of said cylinder.

13. The small watercraft of claim 12, wherein said exhaust sections cross each other at the longitudinal center line of the hull and have an exaggerated length for facilitating exhaust tuning of the engine.

14. The small watercraft of claim 13, wherein each of said exhaust sections includes an expansion chamber symmetrically disposed with respect to said longitudinal center line.

15. The small watercraft of claim 14, wherein a support is provided for each of said expansion chambers.

16. The small watercraft of claim 13, wherein each of said exhaust sections includes a water trap device symmetrically disposed with respect to said longitudinal center line.

17. The small watercraft of claim 13, wherein each of said exhaust sections includes a discharge end at the transom of the watercraft symmetrically disposed with respect to the longitudinal center line.

18. The small watercraft of claim 13, further including a fuel tank located behind said engine in said hull, and said fuel tank being symmetrically disposed with respect to said longitudinal center line.

19. A small watercraft comprising a hull having a length in a longitudinal direction and a width in a lateral direction, a multi-cylinder engine carried by said hull, an exhaust system including multiple separate exhaust conduit portions that communicate directly with a respective cylinder of said engine, and said multiple separate exhaust conduit portions extending behind the engine in the longitudinal direction of the hull.

20. The small watercraft of claim 19, wherein said engine is a V-type engine having a pair of cylinder banks angled partially in the lateral direction of the hull.

21. The small watercraft of claim 20, further including an induction system for said engine at least partially disposed between said cylinder banks.

22. The small watercraft of claim 19, wherein said hull includes a longitudinal center line, said exhaust conduit portions include corresponding exhaust conduit sections which are arranged to be symmetric with respect to the longitudinal center line.

23. The small watercraft of claim 22, wherein each exhaust conduit portion extends from a rear part of said cylinder.

24. The small watercraft of claim 23, wherein each of said exhaust sections includes an expansion chamber.

25. The small watercraft of claim 24, wherein a support is provided for said expansion chambers.

26. The small watercraft of claim 23, wherein at least one water trap device communicates with said exhaust sections.

27. The small watercraft of claim 23, wherein said exhaust system includes at least one discharge end at a transom of the watercraft.

28. The small watercraft of claim 23, wherein said exhaust system includes an expansion chamber symmetrically disposed in the longitudinal center line of the hull.

29. The small watercraft of claim 28, wherein a support is provided for said expansion chamber.

30. The small watercraft of claim 19, wherein each exhaust conduit portion extends from a front part of said cylinder.

31. The small watercraft of claim 30, wherein said exhaust sections cross each other at the longitudinal center line of the hull and have an exaggerated length for facilitating exhaust tuning of the engine.

32. The small watercraft of claim 31, wherein each of said exhaust sections includes an expansion chamber symmetrically disposed with respect to said longitudinal center line.

33. The small watercraft of claim 32, wherein a support is provided for each of said expansion chambers.

34. The small watercraft of claim 31, wherein each of said exhaust sections includes a water trap device symmetrically disposed with respect to said longitudinal center line.

35. The small watercraft of claim 31, wherein each of said exhaust sections includes a discharge end at the transom of the watercraft symmetrically disposed with respect to said longitudinal center line.

36. The small watercraft of claim 31, further including a fuel tank located behind said engine in said hull, and said fuel tank being symmetrically disposed with respect to said longitudinal center line.

37. The small watercraft of claim 19, further including an output shaft rotatably driven by said engine, said output shaft having a length in a longitudinal direction and defining a rotational axis, said exhaust system including at least one exhaust inlet end directly communicating with a respective cylinder of said engine, and said at least one exhaust inlet end having an exhaust flow axis extending in a direction generally parallel to the longitudinal center line of the output shaft.

38. A small watercraft comprising a hull having a length in a longitudinal direction between fore and aft ends of the watercraft and a width in a lateral direction, an in-line, multi-cylinder engine carried by said hull, said engine including a cylinder block having a plurality of cylinders angled partially in the lateral direction of the hull and an induction system angled partially in an opposite lateral direction of the hull, a longitudinally extending valley formed between said partially angled cylinders and induction system, an exhaust system including a plurality of exhaust inlet ends directly communicating with the respective cylinders of said engine, said plurality of exhaust inlet ends having a corresponding plurality of exhaust flow axes extending forwardly and said exhaust system extending at least partially within said valley between said induction system and said cylinders and around and partially beneath said engine.

39. The small watercraft of claim 38, wherein said exhaust system includes an expansion chamber provided on an opposite side of the engine from said exhaust inlet ends.

40. A small watercraft comprising a hull having a length in a longitudinal direction and a width in a lateral direction, the hull including a longitudinal center line, a multi-cylinder engine carried by said hull, said engine including a crankshaft that rotates about a longitudinally extending rotational axis defined by said crankshaft, each cylinder having a cylinder axis and a cylinder plane defined by a plane that includes said cylinder axis and lies perpendicular to said crankshaft rotational axis, and an exhaust system including at least one exhaust inlet end directly communicating with a respective cylinder of the engine, said at least one exhaust inlet end having an exhaust flow axis which is skewed relative to the corresponding cylinder plane.

41. The small watercraft of claim 40, wherein said exhaust system includes multiple exhaust portions that communicate directly with the respective cylinders of said engine, the exhaust portions include corresponding exhaust sections that extend rearwardly of said engine, and each of said exhaust sections having a respective exhaust flow axis that is symmetrically located with respect to said longitudinal center line.

42. The small watercraft of claim 40, wherein said exhaust flow axis is perpendicular to said cylinder plane.

43. The small watercraft of claim 40, wherein said exhaust flow axis is not parallel to said cylinder plane.

* * * * *